United States Patent [19]

Baugh et al.

[11] 4,138,827

[45] Feb. 13, 1979

[54] WRIST MOUNTED HAIR DRYER

[76] Inventors: Ronald Baugh; Claudia Baugh, both of 975 S. 3rd St., Jacksonville, Oreg. 97530

[21] Appl. No.: 849,869

[22] Filed: Nov. 9, 1977

[51] Int. Cl.[2] ..... A45D 20/25

[52] U.S. Cl. ..... 34/98; 34/243 R; 132/9

[58] Field of Search ..... 34/96, 97, 98, 243 R; 219/367, 366, 370; 128/136; 132/9

[56] References Cited

U.S. PATENT DOCUMENTS

| | | | |
|---|---|---|---|
| 818,618 | 4/1906 | Fraley | 128/36 |
| 2,268,294 | 12/1941 | Mayer | 34/96 |

FOREIGN PATENT DOCUMENTS

| | | | |
|---|---|---|---|
| 454686 | 5/1913 | France | 34/243 R |

*Primary Examiner*—George H. Krizmanich

[57] ABSTRACT

A wrist mounted hair drying apparatus for blowing heated air to the palm of the hand wherein it could be directed to the hair of the user in concentrated form. The apparatus includes a motor driven blower mounted by a strap on the wrist of the user. The outlet of the blower includes a flexible hose terminating in an oval-shaped ring mounted over the fingers of the user and having a plurality of air openings along one surface thereof adjacent to the palm for concentrating air from the blower in the palm of the hand of the user. Alternatively, a ring can mount a flexible hose having one or more ducts on the finger of the user, the hose being connected to the blower outlet.

4 Claims, 5 Drawing Figures

WRIST MOUNTED HAIR DRYER

PRIOR ART

The following U.S. patents are considered pertinent: Nos.

818,618
1,603,117
2,234,337
2,713,627
2,834,866
3,284,611
3,308,268
3,623,481

BACKGROUND OF THE INVENTION

This invention relates to a portable hair drying apparatus, and more particularly, a hair drying apparatus adapted to be mounted on the wrist of the hand.

Present portable hair drying apparatus is cumbersome and bulky having to be held in one hand while the other hand manipulates a comb or brush for use in conjunction with the hair dryer. This invention provides a hair drying apparatus which is mounted on the wrist of the user and which concentrates hot air in the palm of the hand so it can be easily directed to the hair to dry the same while manipulating a brush or comb with the same hand. Not only can the air be concentrated, which was unavailable heretofore, but by means of the novel mounting of the present invention the hair dryer is supported by the hand and arm resulting in a substantial decrease in fatigue in use of this type of apparatus.

SUMMARY OF THE INVENTION

In accordance with the invention, a motor driven hot air blower is mounted by a strap on the wrist of the user. The outlet of the blower is connected to a flexible hose which mounts an expandable oval ring which slips over the fingers onto the palm of the hand of the user. The expandable oval ring includes a plurality of holes along its bottom surface through which air is blown and concentrated in the palm of the hand. The air concentrated and blown into the palm of the hand can then be directed to the head of the user to dry wet hair. Alternatively, an air tube can be mounted by a ring to one of the fingers of the hand. The air tube is connected to the blower and terminates in holes adjacent to palm of the user or has branched ducts disposed between the fingers for providing air to the palm of the hand.

BRIEF DESCRIPTION OF THE DRAWING

Further objects and advantages of the invention will become apparent from the following description and claims, and from the accompanying drawing wherein:

DETAILED DESCRIPTION OF THE PREFERRED EMBODIMENT

Figure 1:
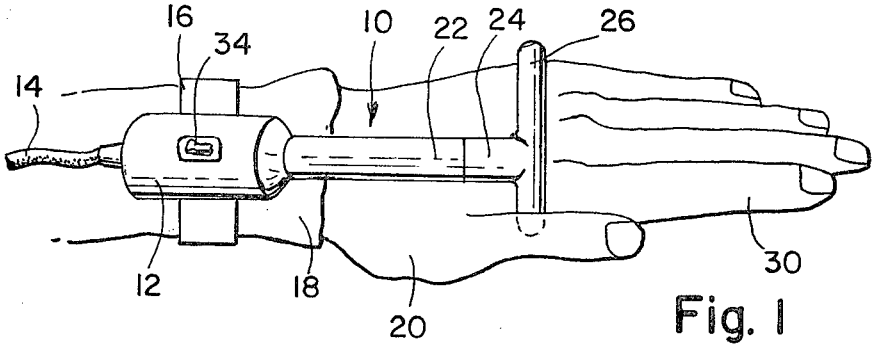
FIG. 1 is a side view in elevation of the wrist mounted hair dryer of the present invention.

Referring now in detail to the drawing, wherein like numerals indicate like elements throughout the several views, the wrist mounted hair dryer 10 of the present invention includes a combination heater, blower, and motor unit 12 connected by a wire 14 to a source of electricity for operating the motor in unit 12. Unit 12 is mounted by a strap 16, having suitable fasteners such as "Velcro," on the wrist 18 of the hand 20 of a user. A typical blower and motor unit 12 is well known in the art and is shown for example in U.S. Pat. No. 2,713,627. While the motor-blower unit in this patent fails to show heating elements, such, as commonly known, can be included within the apparatus illustrated.

The outlet of unit 12 is connected to a flexible tube 22 which telescopically receives an extension 24 connected to an expandable, oval-shaped ring 26 having a plurality of openings 28 on its bottom surface. Oval rings may be made from flexible rubber or the like and is slipped over the fingers 30 of hand 20 so that the openings 28 extend along the palm 32 of the hand 20.

By operating a suitable switch 34 on unit 12, heated air is blown through flexible tube 22 and oval ring 26 through openings 28 into the interior of the hand 20 along the palm 32. The air may be concentrated by the palm of the hand above the hair of the user to dry the same while manipulating a brush or comb with the hand 20. Because of the support of drying apparatus 10 by the hand 20 and wrist 18 use of the apparatus 10 is not fatiguing.

Figure 4:
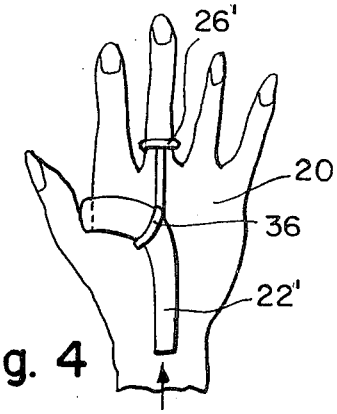
FIG. 4 is a top plan view of an alternate embodiment of the hair dryer.
Figure 2:
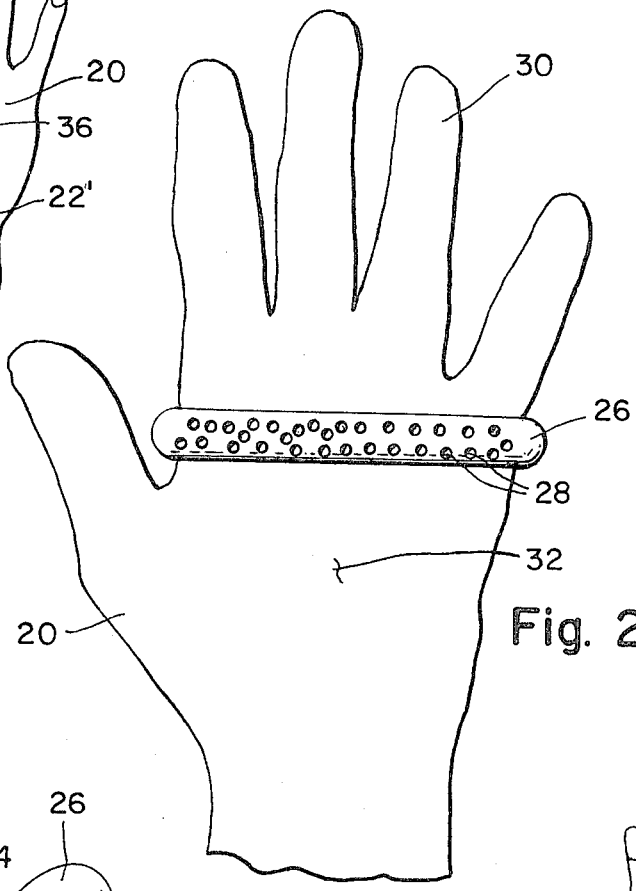
FIG. 2 is a bottom plan view of the wrist mounted hand dryer of FIG. 1.
Figure 3:
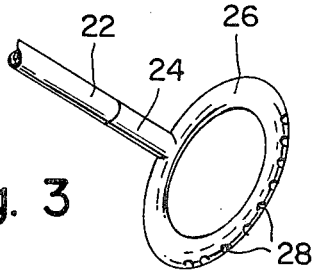
FIG. 3 is a perspective view of a portion of the hair dryer of FIG. 1.

FIG. 4 illustrates that in lieu of oval ring 26, the flexible air tube 22' can terminate in an opening between the thumb and forefinger of the hand 20 for directing air to the interior palm of the hand 20. Tube 22' can be supported by a ring 26' on the index finger of the hand 20. Ring 26' is connected by a clamp 36 to tube 22'.

Figure 5:
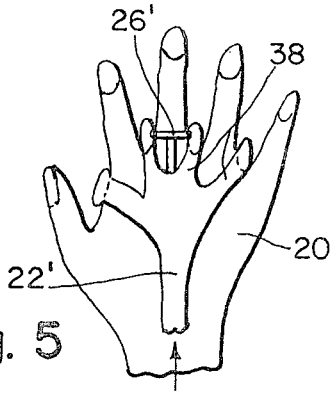
FIG. 5 is a top plan view of still another alternate embodiment of the hair dryer.

Alternatively, tube 22' can branch off into a plurality of separate ducts 38 which are disposed between the fingers of the hand 20, as illustrated in FIG. 5 for concentrating the air in the palm of the hand 20. Ring 26' can be connected directly to duct 22' for supporting the ducts 22' and 38 on the index finger of the hand 20.

While a specific embodiment of a wrist mounted hair dryer has been disclosed in the foregoing description, it will be understood that various modifications within the spirit of the invention may occur to those skilled in the art. Therefore, it is intended that no limitations be placed on the invention except as defined by the scope of the appended claims.

We claim:

1. A wrist mounted hair drying apparatus comprising:

motor driven air blower means, strap means connected to said blower means for mounting said blower means on the wrist of a user, flexible hose means connected to the outlet of said blower means adapted to extend along the back of a hand of a user, said flexible hose means terminating in at least one air duct adjacent the palm of the hand of the user, and means for mounting said flexible hose means on the hand of the user.

2. The drying apparatus of claim 1 wherein said mounting means includes an expandable oval ring connected to said flexible hose means, said expandable oval ring including a plurality of air ducts along a surface thereof adjacent the palm of the hand of the user.

3. The hair drying apparatus of claim 1 wherein said mounting means includes a ring adapted to receive a finger of the hand therethrough, and means connecting said ring to said flexible hose means.

4. The hair drying apparatus of claim 3 wherein said flexible hose means includes a plurality of branch ducts extending between the fingers of the hand and opening adjacent to palm of the hand of the user.

* * * * *